United States Patent [19]

Thomas et al.

[11] 3,971,110

[45] July 27, 1976

[54] METHOD FOR FABRICATING AN ELECTRON-EMISSION CATHODE

[75] Inventors: Richard E. Thomas, Riverdale, Md.; George A. Haas, Alexandria, Va.

[73] Assignee: The United States of America as represented by the Secretary of the Navy, Washington, D.C.

[22] Filed: Sept. 11, 1975

[21] Appl. No.: 612,517

[52] U.S. Cl. ..... 29/25.18; 29/25.17; 29/182.1

[51] Int. Cl.$^2$ ..... H01J 9/12

[58] Field of Search ..... 29/25.17, 182.1, 25.18

[56] References Cited

UNITED STATES PATENTS

| | | | |
|---|---|---|---|
| 3,069,757 | 12/1962 | Beggs et al. | 29/182.1 |
| 3,164,466 | 1/1965 | Yasuda et al. | 29/182.1 X |
| 3,290,124 | 12/1966 | Holtzclaw, Jr. | 29/182.1 |

*Primary Examiner*—Richard B. Lazarus
*Attorney, Agent, or Firm*—R. S. Sciascia; Philip Schneider; George Montanye

[57] ABSTRACT

An improved technique for forming an electron emitting cathode of iridium and similar noble metals. A mixture of powders including a matrix material of one of the noble metals and a pore forming material of silver is shaped into a cathode configuration and sintered at a temperature sufficient to evaporate the silver, thereby producing a porous matrix. The matrix is impregnated with an active material and dried to produce a cathode having increased electron emission characteristics allowing operation at lower temperatures for longer time periods.

16 Claims, No Drawings

METHOD FOR FABRICATING AN ELECTRON-EMISSION CATHODE

BACKGROUND OF THE INVENTION

The present invention relates to electron emission devices and more particularly to improved techniques for fabricating thermionic matrix cathodes.

In the past, thermionic matrix cathodes have been fabricated using tungsten-molybdenum as a matrix metal impregnated with active agents to produce a thin emitting surface layer. It has been found that the thickness of the surface layer limits the amount of emission obtained, the emission being higher if the thickness is increased. Increasing the emission by operating the cathodes at higher temperatures causes high rates of evaporation of the active materials and severely limits the lifetime of the cathode by depleting these materials.

While it is known that emission characteristics of cathodes can be modified by use of particular noble metals, attempts to provide suitable cathodes involving these metals have met with somewhat limited success. In some instances the noble metals have been coated on conventional cathode materials or alloyed with other metals to improve the cathode characteristics. Although some improvement was shown, the cathode life was limited by the life of the coated layer and cathode matrices formed from the noble metals still remained impractical due to problems in shaping and pore forming of the noble materials. In particular, the techniques used to form matrix cathodes with noble metals resulted in a non-machinable matrix which alloyed with the pore forming material and allowed shrinkage of the matrix, thereby resulting in non-uniform cathodes of limited life span and irregular emission characteristics. The higher emission rates that might have been expected have been practically unobtainable since good matrices of noble metals have not been realized.

Accordingly, the present invention has been developed to overcome the specific short comings of prior techniques and to provide a technique for forming a highly reliable cathode matrix for use in electron devices.

SUMMARY OF THE INVENTION

It is therefore an object of the present invention to provide an improved thermionic device.

Another object of the invention is to provide a technique for forming a highly reliable cathode matrix.

A further object of the invention is to provide a thermionic cathode matrix of more predictable and uniform structure.

Still another object of the invention is to provide a technique for preventing alloying and shrinkage in the formation of thermionic cathodes.

A still further object of the invention is to provide a technique for allowing more reliable machining of a matrix cathode.

Yet another object of the invention is to provide a technique for constructing thermionic matrix cathodes that operate at higher emission densities for longer time periods.

In order to accomplish the above and other objects, the present invention uses silver as the pore forming material when forming the cathode matrix. Silver powder is mixed with a powder of the noble metal and inserted into a die structure to form a cathode shape.

The powder is compressed at higher pressures and heated to evaporate the silver and form a sintered noble metal matrix of more uniform and predictable construction. By use of the silver, alloying and shrinkage of the metal matrix is prevented allowing accurate control over the structure of the metal matrix. The matrix is then machined by refilling the pores with silver to prevent closing of the pores during machining. Subsequently the silver is reevaporated after machining and an etching process used to reopen any pores that may have been partially closed by machining. The matrix is then impregnated with a solution of active material to insure the formation of a thicker surface layer after heating of the cathode. The cathodes formed in this manner are able to be carefully controlled in porosity and structural characteristics and capable of producing higher emission at lower temperatures than previously attained.

Other objects, advantages, and novel features of the invention will become apparent from the following detailed description of the invention.

DETAILED DESCRIPTION OF A PREFERRED EMBODIMENT

According to the present invention, the cathode matrix is formed by first selecting a powder of the noble metal desired, and thoroughly mixing the noble metal powder with a selected amount of silver powder as the pore forming material. The noble metal could be, for example, iridium of 100 mesh mixed in amounts of 7 parts by volume with 3 parts by volume of 100 mesh silver powder. The powders can be mixed in any conventional manner so long as the technique insures that the silver powder is uniformly mixed with the iridium powder. A metal sleeve is then selected (e.g. cylinder of Ta ⅝ inch length and 0.150 inch inside diameter with 0.005 inch wall thickness) to be used as the contact cylinder for the finished cathode. The cathode sleeve is inserted into a die of conventional construction having a bottom anvil surface abutting against one end of the cathode sleeve and having side walls in contact with and supporting the outer cylindrical surface of the sleeve. The mixture of iridium-silver powders is then poured into the sleeve from the open end to fill a volume sufficient to form a cathode of desired thickness (e.g. an amount filling a volume of the cylinder to about ⅛ inch up from the end abutting the anvil surface). A cylindrical punch, having a diameter such as to allow sliding engagement along the inner surface of the sleeve, is then inserted through the open end of the tantalum cylinder and into contact with the powder. Using a hydraulic press to apply pressure to the punch, the mixture of powders is compressed between the punch end and anvil at a pressure of 40,000 psi to shape the cathode at the end of the tantalum sleeve. Thus, when the sleeve is removed from the anvil, the pressed volume of powders forms a slug of Ir-Ag powder which remains in the Ta sleeve forming the cathode end face of the cylinder.

The sleeve-powder structure is now placed in a suitable structure for sintering which can be, for example, an RF vacuum furnace, and heated to a temperature of 1700°C for 30 minutes. At the end of this time period, the silver will have been removed from the matrix by evaporation during sintering leaving only a porous matrix of iridium with about 30% of the matrix volume as pores. In contrast to prior techniques, the silver powder has such characteristics as to prevent alloying with the iridium during the sintering process and shrinkage of the matrix structure. The matrix can therefore be fabricated with more predictable and uniform pore distribution resulting in a matrix devoid of irregular and uncontrolled structural deficiencies.

After sintering is completed the surface of the matrix can then be machined to the desired flatness or to some other shape (e.g. concave) if desired. In order to machine the surface the pores of the matrix are refilled with silver to prevent excessive closing of the pores on the surface during machining. The refilling with silver is accomplished by dipping the sintered matrix in molten silver while contained within a vacuum chamber (e.g. $10^{-5}$torr) causing the silver to be drawn into the pores by capillary action. When the silver solidifies the matrix may then be machined to the desired shape. After machining, the silver is reevaporated by heating the matrix to 1700°C in an RF vacuum furnace for about 30 minutes. The surface of the matrix can then be electrolytically etched (e.g. 5 minutes at 3 amps) in a solution such as 1 part concentrated HCl and 5 parts water to reopen any pores that may have been partially closed by the machining process.

Upon completion of the etching, the matrix is next impregnated with the active material needed to achieve electron emission. For this matrix is placed in a saturated solution of Ba, Ca, and Sr acetate in mole ratios such as 5 Ba: 3 Ca: 2 Sr, and allowed to soak under ultrasonic agitation for a minimum of about 15 minutes. After that time, the agitation can be removed and the matrix allowed to soak for an additional 2 hours. The matrix is then removed from the acetate solution and placed in a saturated solution (water solvent at room temperature) of ammonium carbonate where it is allowed to soak for a minimum of 6 hours to allow the Ba, Ca, and Sr acetates to be converted to a solid precipitate of Ba, Ca, and Sr carbonates which fill the pores of the matrix. If needed, this procedure can be repeated to insure adequate impregnation of the matrix.

At this point the completed matrix is allowed to dry. The matrix cathode structure is then ready for use and can be inserted into an appropriate assembly for use as a thermionic matrix cathode in such devices as microwave vacuum tubes, cathode ray tubes, and various other types of electronic devices needing thermally activated electron sources. In a typical test situation the cathode can be mounted in a vacuum tube diode assembly to determine the electron emission at various temperatures. For instance, the cathode can be placed in an assembly evacuated to provide adequate vacuum conditions for device operation, and the cathode activated by slowly heating it over a period of 2 hours to a temperature of about 1100°C. The heating can be performed using a conventional cathode heating coil which fully activates the cathode for electron emission when a negative voltage is applied to the cathode structure.

Using the above matrix and technique, it was found that the resulting iridium cathode structure produced increased emission density, over a standard tungsten matrix cathode at the same temperature, by at least an order to magnitude. In addition, using the silver filler powder as the pore forming material, the iridium matrix was able to be precisely controlled in porosity volume thereby providing more uniform characteristics. Further in forming the matrix according to the above described technique, a cathode structure was produced which appeared to be capable of higher emission because of the formation of a thicker surface layer of a barium-oxygen compound on the iridium matrix than previously attainable with prior techniques and structures. As a result of the greater emission densities, the cathode can be (1) operated at lower temperatures thereby extending the active lifetime or (2) operated at higher electron emission densities normally prevented by the required high temperatures which would otherwise produce deleterious evaporation. This resultant high emission capability thus allows greater latitude and economic savings in the design of such devices as microwave tubes, where tubes not presently feasible at high current densities (70 A/cm$^2$ for short periods) can be constructed.

As can be seen from the above description, an improved cathode can be formed using the present inventive technique which has more predictable structural characteristics, higher emission capabilities and longer life spans. Using presently available silver and noble metal powders to fabricate the matrix and acetate impregnation to provide the active materials, the resulting cathode structure will produce characteristics not previously attainable in any practical device or technique.

While the invention has been described with particular reference to iridium as the matrix material, other noble metals such as osmium, ruthenium, or combination of such metals, can also be used. In addition, the impregnation of the active material into the matrix can be done by a direct mixing of the impregnate powder with the noble metal and silver powder prior to the pressing and sintering. Alternatively, a commonly used cathode material such as barium-calcium aluminate could be fused into the iridium matrix at high temperatures in much the same way as the acetate solution was done at room temperatures. It is further noted that by using different dies, anvils, and punches, the shape of the cathode can be modified to meet the requirements for essentially any type of vacuum tube.

Obviously many other modifications and variations of the present invention are possible in light of the above teachings. It is therefore to be understood that within the scope of the appended claims the invention may be practiced otherwise then as specifically described.

What is claimed and desired to be secured by Letters Patent of the United States is:

1. A method for fabricating a thermionic cathode comprising:

uniformly mixing a quantity of noble metal powder with a quantity of silver powder;

compressing said mixture under pressure to form a shaped article;

sintering said article at a temperature sufficient to evaporate said silver and form a porous matrix; and impregnating said matrix with an active material to fill the matrix pores and form an electron-emissive cathode, said active material consisting of at least one material selected from the group Ba, Ca and Sr.

2. The method of claim 1 wherein the step of mixing includes mixing a noble metal selected from the group consisting of iridium, osmium, ruthenium and alloys thereof.

3. The method of claim 2 wherein the step of mixing includes mixing 7 parts by volume of 100 mesh noble metal powder with 3 parts by volume of 100 mesh silver powder.

4. The method of claim 3 wherein said step of compressing includes compressing said mixture under a pressure of 40,000 psi.

5. The method of claim 4 wherein said step of sintering includes sintering said article at a temperature of 1700°C for 30 minutes.

6. The method of claim 5 wherein said step of impregnating includes soaking said matrix in a solution of Ba, Ca, Sr, acetates.

7. The method of claim 6 wherein said acetate solution has a mole ratio of 5Ba:3Ca:2Sr.

8. The method of claim 7 wherein said impregnating step further includes soaking said matrix in a saturated solution of ammonium carbonate after soaking in said acetate.

9. The method of claim 8 wherein said soaking steps include soaking said matrix in said acetate for 15 minutes under ultrasonic agitation and 2 hours thereafter and then soaking said matrix in said carbonate solution for 6 hours.

10. The method of claim 1 further including the steps of:

refilling the pores of said matrix with silver after the sintering step;

machining the matrix surface to a desired shape; and reevaporating the silver from the pores of the matrix.

11. The method of claim 10 further including the step of, etching the matrix after the reevaporating step to reopen any pores closed during the machining step.

12. A method for fabricating a thermionic cathode comprising:

uniformly mixing a quantity of noble metal powder with a quantity of silver powder;

compressing said mixture under pressure to form a shaped article;

sintering said article at a temperature sufficient to evaporate said silver and form a porous matrix;

soaking said matrix in an acetate solution of at least one of the group of elements consisting of barium, calcium and strontium; and soaking said matrix in a carbonate solution to transform said acetates into carbonates, thereby forming an electron-emissive cathode.

13. A method as in claim 12, wherein said acetate and carbonate solutions are saturated solutions.

14. A method as in claim 12, wherein said acetate solution is a mixture of Ba, Ca, and Sr acetates.

15. A method as in claim 12, wherein the soaking in the carbonate solution is allowed to continue for at least 6 hours.

16. A method as in claim 12, wherein said soaking steps are effectuated at room temperature.

* * * * *